US012723336B2

(12) United States Patent
Lee et al.

(10) Patent No.: US 12,723,336 B2
(45) Date of Patent: Sep. 1, 2026

(54) METHOD FOR THE CONTINUOUS PRODUCTION OF NONWOVEN FABRIC, AND ASSOCIATED NONWOVEN FABRIC PRODUCTION APPARATUS AND NONWOVEN BOARD

(71) Applicant: NVH CZECH S.R.O., Ceska Lipa—Dobranov (CZ)

(72) Inventors: Wonku Lee, Gyunggi-Do (KR); Norbert Nicolai, Schermbeck (DE)

(73) Assignee: NVH CZECH S.R.O., Cezka Lipa (CZ)

( * ) Notice: Subject to any disclaimer, the term of this patent is extended or adjusted under 35 U.S.C. 154(b) by 402 days.

(21) Appl. No.: 18/010,047

(22) PCT Filed: Jun. 15, 2021

(86) PCT No.: PCT/DE2021/100511

§ 371 (c)(1),
(2) Date: Dec. 13, 2022

(87) PCT Pub. No.: WO2021/254565

PCT Pub. Date: Dec. 23, 2021

(65) Prior Publication Data

US 2023/0228018 A1 Jul. 20, 2023

(30) Foreign Application Priority Data

Jun. 19, 2020 (DE) ..... 10 2020 116 315.0

(51) Int. Cl.
*D04H 1/732* (2012.01)
*D04H 1/542* (2012.01)
*D04H 1/558* (2012.01)

(52) U.S. Cl.
CPC ..... *D04H 1/732* (2013.01); *D04H 1/542* (2013.01); *D04H 1/558* (2013.01)

(58) Field of Classification Search
CPC ..... D04H 1/54; D04H 1/542; D04H 1/558; D04H 1/732; D04H 1/74; D04H 1/4382; D04H 1/72
See application file for complete search history.

(56) References Cited

U.S. PATENT DOCUMENTS 5,503,782 A 4/1996 Dyrud et al.
5,766,531 A 6/1998 Cadieux et al.
(Continued)

FOREIGN PATENT DOCUMENTS

DE 102010034159 A1 2/2012
FR 2922901 A1 5/2009
(Continued)

OTHER PUBLICATIONS

International Search Report issued on Oct. 1, 2021, in International Application No. PCT/DE2021/100511.

*Primary Examiner* — Lynda Salvatore
(74) *Attorney, Agent, or Firm* — Patent Central LLC; Stephan A. Pendorf

(57) ABSTRACT

A method for the production of a continuous nonwoven fabric from fiber mixtures of carrier fibers and binding fibers, comprising the steps: a. Feeding fibers; b. Breaking up, combing and opening out the fibers; c. Mixing the fibers; d. Sucking the fibers between two opposing air-permeable conveyor belts running at identical speed, such that the air is sucked from the outside in the front section of the conveyor belts in such a way that the air flow is always sucked through the deposited nonwoven fabric by air extraction at different times and different locations across the width and parallel to the conveyor belts and the fibers are thereby positioned perpendicular to the surface of the conveyor belts; e. Thermally solidifying the nonwoven fabric
(Continued)

created by heating with hot air or short-wave radiation and cooling. Also a nonwoven fabric production apparatus.

6 Claims, 5 Drawing Sheets

(56) References Cited

U.S. PATENT DOCUMENTS

| | | | | |
|---|---|---|---|---|
| 5,974,631 | A * | 11/1999 | Leifeld | D04H 1/732 19/296 |
| 2004/0097155 | A1 | 5/2004 | Olson et al. | |

FOREIGN PATENT DOCUMENTS

| | | | |
|---|---|---|---|
| WO | 006824 | A1 | 11/2000 |
| WO | 2006092029 | A1 | 9/2006 |
| WO | 2009056745 | A2 | 5/2009 |

* cited by examiner

METHOD FOR THE CONTINUOUS PRODUCTION OF NONWOVEN FABRIC, AND ASSOCIATED NONWOVEN FABRIC PRODUCTION APPARATUS AND NONWOVEN BOARD

The invention relates to a method for the production of a continuous nonwoven fabric from, as well as the associated nonwoven fabric manufacturing apparatus and nonwoven fabric board made of fiber mixtures of carrier fibers and binder fibers.

A nonwoven fabric is a structure made of fibers of limited length, filaments or chopped yarns. Since a wide range of raw materials can be used for nonwoven fabrics and there are a variety of manufacturing processes and methods, nonwoven fabrics can be specifically adapted to a wide range of application requirements.

For example, there are fiber webs/nonwoven fabrics weighing several kilograms per square meter for insulation and also webs weighing less than one gram per square meter, known as nanofleeces.

According to the requirements, the nonwoven fabrics/fiber webs differ in their structure.

High absorption nonwoven fabrics, for example, are dense, have high flow resistance and consist of thin or very thin fibers. Meltblow nonwoven fabrics are a special version of these. In the meltblown process, the polymer strand exiting the die is directly stretched by hot air flowing in the exit direction of the filaments. The fibers swirled by the air flow are deposited on a mesh belt. The deposit can produce a fine web of entangled polymer fibers.

Electrostatic-formed nonwoven fabrics are formed by the formation and deposition of fibers from polymer solutions or melts under the influence of an electric field.

Nonwoven fabrics for thermal insulation, on the other hand, are more voluminous. Couplings of meltblow nonwoven fabrics with staple fibers to create a voluminous structure are also known. If nonwoven fabrics are subject to mechanical load and have elastic properties, they preferably have fibers oriented in the direction of the load. Such nonwoven fabric insulations are used, for example, in vehicles under the carpet or behind the bulkhead, or are also used for the manufacture of air-permeable mattresses.

The fibers can be oriented differently in the nonwoven fabric. Usually, they lie more or less parallel to the surface. A distinction is made between oriented nonwoven fabrics, in which the fibers are very strongly oriented in one direction, cross-layer nonwovens, in which the fibers are preferably oriented in two directions by superimposing individual fiber piles or nonwovens with a longitudinal orientation of the fibers to the overall nonwoven by means of crosslappers, and random-layer nonwoven fabrics, in which the fibers or filaments can assume any direction.

In the state of the art, a distinction is made between different manufacturing processes for the production of nonwoven fabrics from staple fibers. Mechanically formed nonwovens are those which are produced by means of carding or carding or in airlay processes. The carding process is a dry manufacturing process in which several layers of nonwovens are laid on top of each other. The fibers lie mostly flat, parallel to the surface. Depending on how the nonwoven fabrics are laid down, oriented nonwovens or cross-ply nonwovens are produced. If special cards are used, tangled nonwovens can also be formed.

Aerodynamically formed nonwoven fabrics are those formed from fibers by means of an air stream on an air-permeable backing. If the nonwoven fabrics are produced by airlay systems, the fibers are sucked onto an air-permeable belt and lie oriented in the surface. Depending on the laydown and belt transport speed, the fibers can be positioned at an angle of between 70° and 80° to the surface without being completely perpendicular. In this case, the fibers take up an opposite angle on both surfaces, which causes a strong curvature of the fibers.

In hydrodynamically formed nonwovens, fibers are suspended in water and deposited on a water-permeable base. This process is also known as the wet process.

Fibers perpendicular to the surface can be obtained with the Struto process, which is also known as the Wavemacker or V-Lap process. This is a process in which a flat nonwoven with vertical folds is produced from a carded nonwoven with a horizontal fiber layer.

Various possibilities are known for the subsequent bonding of the nonwoven fabrics produced in the manner described above, such as the possibility of a frictional bond or the combination of a frictional and a form bond in a mechanical manner or the possibility of a material bond, which can be achieved both chemically by adding a binder and thermally by using thermoplastics. The most commonly used method for bonding is the use of thermoplastics in the form of low-melting plastic, preferably in fiber form. These so-called binder fibers have a melting range of 100-200° C. and are preferably available as compact fibers or bicomponent fibers.

DE 10 2010 034 159 A1 discloses a discontinuous solution for the production of nonwoven components with fibers oriented perpendicular to the surface, in which the fibers are transported into a mold provided with through-flow openings via an air stream, the mold being of divided design and being moved apart before filling, after filling, the fiber material is compressed by closing the mold and then the fiber material is heated by hot air until the fibers have bonded to one another, the fibers in the mold being oriented perpendicular to the feed direction and in the direction of the air flowing out of the mold before compression.

Furthermore, from the publication WO 2006/092029 A1 a textile lapping machine is known having an inclined comb which deposits a vertically descending fiber web/nonwoven fabric onto a screen belt of an endless conveyor running through an oven. The reciprocating pressure bar presses the pleats formed by the comb into a shark unit extending across the width of the mesh belt. The unit has a toothed plate that initially slows the folded web and longitudinal fingers that overlie the conveyor and form a shallow overlap zone. A textile card feeds the fibrous web to the lapping zone and the oven fuses all the low melting synthetic fibers in the web with the surrounding fibers to give a nonwoven with a density of 80-2000 g/m$^2$. The comb web direction remains constant and the presser bar and shark unit are moved towards and away from the comb. The drives to the comb and presser are independent.

In the publication US 2004/0097155 A1 an arrangement and a board are described, where in meltblow fibers directly during the manufacturing process crimped rod fibers are mixed in. By drawing the web apart in two porous shafts by means of air, a structure with two surfaces is created, where the fibers lie planar and a thinned out central area where the fibers assume a C-shaped orientation.

In WO 2009/056745 A1, an aerodynamic process is described in which the fibers are transported between at least one moving porous wall by means of an air stream and the air is extracted from the outside. Long fibers are preferably deposited along the porous wall, while predominantly short fibers are deposited perpendicular to the air stream.

The Cormatex company has a system that deposits the fibers in a channel and also extracts them laterally.

The problems in the prior art are that all processes for producing nonwoven fiberboards from staple fibers with fibers oriented perpendicular to the surface have equal density along and across the board in the scattering process.

Other disadvantages in the disclosed technology of WO 2006/092029 A1 are that, due to the same density along and across the blank, only two-dimensional deformation is possible as a result of the wrinkling. The nonwoven splits.

The disclosures in WO 2009/056745 A1 and US 2004/0097155 A1 as well as in the process described by Comatex disclose nonwoven fabrics that have different densities and fiber orientations across the thickness of the nonwoven, with the fibers lying plane-parallel in the surface areas and largely perpendicular in the central area, which in turn makes it difficult to subsequently form the nonwoven into a three-dimensional component.

The processes that use the airlay principle to produce nonwoven fiber blanks (WO 2009/056745 A1, US 2004/0097155 A1 and Comatex—with fibers oriented perpendicular to the surface) allow only slight differences in density along and across the blank.

The disadvantage of all these processes with the same density over the width and length is that after forming with different thicknesses, the density in the thin areas is significantly higher than in the starting material. On the one hand, this leads to a higher weight and, on the other, the thin areas become stiffer and often less acoustically effective.

Nonwoven fabrics produced by a well-known airlay process (WO 2009/056745 A1, US 2004/0097155 A1 and Comatex) always have fibers lying parallel to the surface due to the manufacturing process, which then becomes negatively noticeable during three-dimensional deformation.

The present invention is based on the task of providing a simple and efficient, economical, continuous, aerodynamic manufacturing process as well as an arrangement for the production of nonwoven fabrics/fiber webs with fibers oriented perpendicular to the surface and defined fiber orientation and preferably also density distribution over the length and width of the nonwoven fabrics/fiber web and a corresponding nonwoven for this purpose.

This task is solved with a continuous nonwoven fiber production process from fiber mixtures of carrier fibers and binder fibers according to the main claim as well as an associated nonwoven fiber production arrangement and nonwoven fiber board according to subordinate claims. Further advantageous embodiments are to be taken from the subclaims.

The Method for the production of a continuous nonwoven fabric from fiber mixtures of carrier fibers and binding fibers, comprises the steps of:

a. Feeding fibers;
b. Breaking up/combing and opening the fibers;
c. Mixing of the fibers;
d. Sucking in the fibers between two opposing air-permeable conveyor belts running at the identical speed, such that the air in the front section of the conveyor belts is sucked from the outside in such a way that the air flow is always sucked through the deposited nonwoven fabric parallel to the conveyor belts by temporally and locally varying air suction over the width, and thus the fibers are deposited perpendicular to the surfaces of the conveyor belts;
e. Thermal bonding of the created nonwoven fiber by heating by means of hot air or short-wave radiation and cooling.

Depending on the air guidance, the orientation of the fibers in the front area of the conveyor belts running parallel to each other can be controlled. If the fibers are extracted directly at the beginning of the conveyor belts, the fibers preferentially accumulate parallel to the belts and form a layer. Depending on the amount of air extracted, the ratio of parallel to perpendicular fibers can be controlled.

The air suction can be moved in the front area of the conveyor belts, from the beginning of the conveyor belts along the belts. This makes it possible to change the orientation of the fibers from parallel to the conveyor belts to perpendicular to the conveyor belts.

If the suction area along the belts is different on both sides of the conveyor belts, boards can be produced with one layer of fibers lying parallel to the belts.

To prevent the fibers from being deposited on the belts over a wide area, the filling quantity and belt speed are controlled in such a way that the fiber condensation is always directly at the beginning of the belts.

By controlling the process during start-up, the parallel positioning of the fibers on the belts can be prevented, which brings significant advantages in the deformation of the nonwoven fabrics. In the start-up process, the web build-up is stopped until the belt is filled and then the process is continued continuously (see also FIGS. 9 to 11).

With a temporally varying suction power, the density can be varied via the nonwoven fabric length. The density and thus the properties of the resulting nonwoven can also be adjusted via the belt speed of the conveyor belts. If the suction power and belt speed are coupled, the desired effect of density and property change is enhanced. Due to a locally and temporally varying intensity of the suction line across the width of the nonwoven fabrics, a density distribution is also possible across the width. This makes it possible to produce nonwoven fabrics with localized density differences longitudinally and transversely within a board.

The web thickness can be adjusted in the range from 5 mm to 100 mm by means of a defined adjustable distance between the belts. The web can be pre-compressed by changing the distance between the belts.

The heating of the nonwoven is preferably carried out by means of hot air. In one variant, the heating of the nonwoven can be carried out via short-wave radiation.

Depending on the further use of the nonwoven fabrics, the heating and cooling process differs. In a first embodiment, the nonwoven is heated through so that all binder fibers have been activated and the maximum mechanical properties are achieved in the cold state. The optimum parameters can be determined by preliminary tests. Subsequently, the nonwoven is cooled with air and cut to size according to its subsequent use. FIG. 8 shows the compression hardness versus heating time for a 50 mm thick nonwoven.

In another embodiment, the nonwoven fabric is heated for only a short time, the nonwoven fabric strength is then set so that the nonwoven fabric can be transported and stacked. In FIG. 3, the first heating time would be sufficient for this nonwoven. Here, too, the nonwoven is then cooled and cut to size according to its subsequent use.

In another special design, the nonwoven is completely heated and, when heated through, is deposited directly into a final mold for forming and cooling, thus producing a finished component.

The nonwoven fabric manufacturing apparatus comprising a supply arrangement for carrier fibers, a supply arrangement for binder fibers, at least one opening arrangement or opening/loosening combing arrangement or at least one fiber opener for combing, separating, loosening and detaching the carrier fibers and/or binder fibers; at least one mixing system for mixing the loosened or detached fibers, a transport system with air suction in the front section of the transport system for aligning and depositing the fibers consisting of air guide channels and pressure control nozzles and with a heat source in the rear section of the transport system with subsequent cooling source for thermal bonding of the resulting fiber web/nonwoven fabric, wherein the front section of the transport system with air suction consists of opposing air-permeable conveyor belts running at the same speed, and the loosened and mixed fibers are conveyed between the opposing conveyor belts, and the fibers are arranged in different density over the width and length of the fiber web/nonwoven fabric on the transport belts perpendicular to the conveyor belts due to the air suction from the outside. The conveyor belt spacing can be changed via automatic or manual control.

Subsequently, the transport system with air extraction/suction and heat source can be followed by a conveyor belt for transporting the nonwoven fabric/fiber web away.

Furthermore, a cutting device for longitudinal and transverse cutting can be coupled to the conveyor belt.

Furthermore, tools with three-dimensional contours for the production of molded parts can be arranged downstream of the conveyor belt and the cutting device.

Preferably, the two conveyor belts run parallel. The distance between the air-permeable conveyor belts can be changed in a targeted manner and thus the web thickness can be adjusted.

In a further embodiment, the distance between the belts can be reduced along their length, thus pre-compressing the nonwoven fabric The air extraction/suction area is divided across the width into individual, separately controllable areas. The control can take place via cross-section changes at the same suction pressure or via a change in the suction pressure.

In coupling with the belt speed and the central suction pressure, nonwoven fabrics with defined locally different densities can be obtained.

In a first embodiment, the nonwoven fabric leaves the belt in a cooled state without being transferred to another transport system.

In another embodiment, the heated nonwoven is cut into board sections, deposited into the lower half of a 3-D form, which is run along the bottom, the forming tool is closed with the upper half of the form, the product is pressed into the final mold, and the three-dimensional formed product is cooled.

Further, the cooling source for thermal solidification may be located downstream of the heat source in the rear section of the transport system or cooling the contents of the three-dimensional molded part.

Different approaches can be chosen as a heat source and also a cooling source for thermal solidification. For example, the heat source can be in the form of a hot air stream. In a particular embodiment, the nonwoven is heated by means of short-wave radiation.

The nonwoven can be cooled by cold air or by contact, preferably in the 3-D mold. In particular, if it has been produced accordingly (by means of the process according to the invention and/or by means of the arrangement), the nonwoven fiber board has a defined density distribution over the length and the width.

In the following, embodiments of the invention are described in detail with reference to the accompanying drawings in the description of figures, whereby these are intended to explain the invention and are not to be regarded as necessarily limiting:

It shows:

FIG. 1 a schematic representation of an embodiment example of the vertical alignment of the fibers between two parallel, air-permeable conveyor belts;

FIG. 2 a schematic representation of an embodiment of a nonwoven fiberboard;

FIG. 3 a schematic representation of an embodiment of a nonwoven fiber manufacturing apparatus with separate feed arrangements of carrier fibers and binder fibers, common mixing system and parallel running, air-permeable conveyor belts;

FIG. 4 a schematic representation of a differentiated air flow and—suction across the width;

FIG. 5 schematic illustration of an embodiment of the rear section of a nonwoven fiber manufacturing apparatus with parallel air-permeable conveyor belts, a heat source, a cooling source and a cutting device;

FIG. 6 schematic illustration of an embodiment of the rear section of a nonwoven fiber manufacturing apparatus with parallel air-permeable conveyor belts, a heat source, a cutting device and a three-dimensional molded part;

FIG. 7 a possible density distribution for a floor insulation of a passenger car;

FIG. 8 the compression hardness as a function of the soak time;

FIG. 9 suction of the fibers in two belts running at the same speed in such a way that the fibers are sucked in parallel to the belts;

FIG. 10 the control of fiber filling at the start of production;

FIG. 11 the fiber arrangement in the belts during continuous production and

FIG. 12 the fiber arrangement in the belts with spatially different fiber extraction along the belts in the front area.

At this point it should be pointed out that functionally identical components are provided with uniform reference signs.

Figure 1:
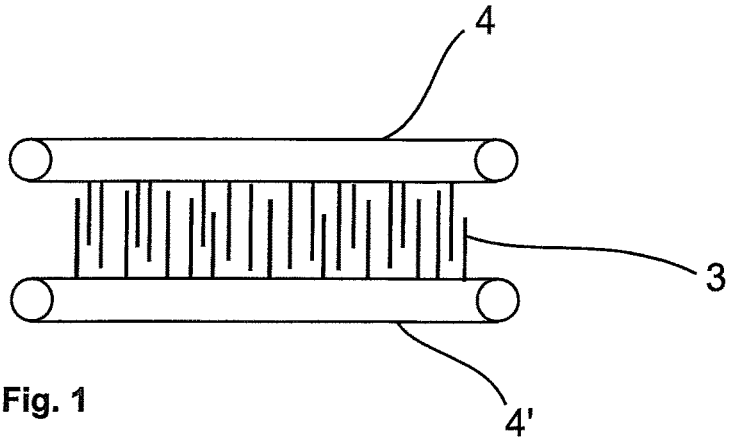
FIG. 1 shows a schematic representation of an embodiment with vertically oriented fibers 3 between two parallel air-permeable conveyor belts 4, 4'.
Figure 2:
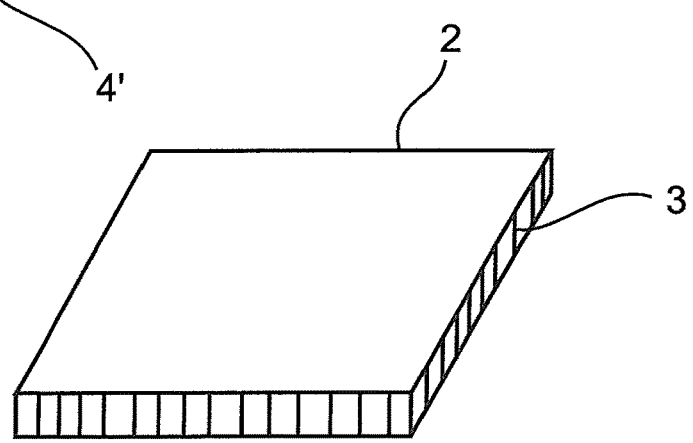
FIG. 2 shows a schematic representation of an embodiment of a nonwoven fiberboard 2 comprising vertically oriented fibers 3.
Figure 3:
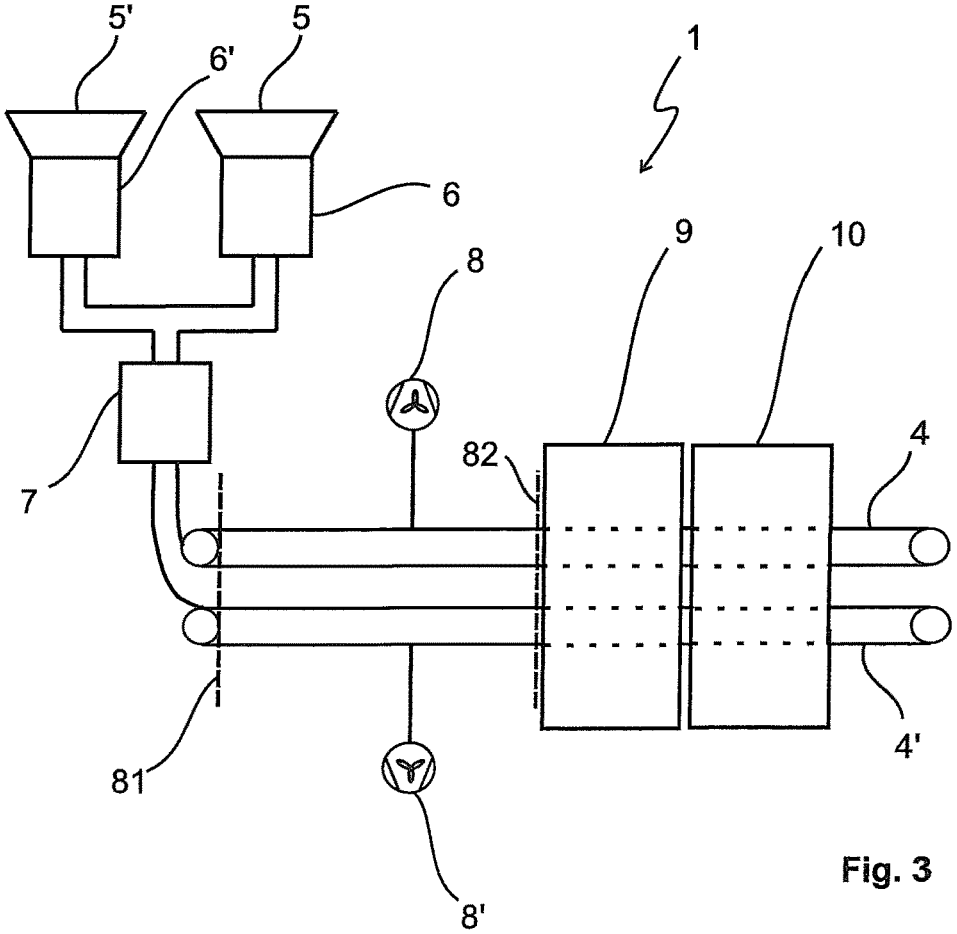

FIG. 3 shows a schematic drawing of an embodiment of a nonwoven fiber manufacturing apparatus 1 with separate feed arrangements 5, 5' of carrier fibers and binder fibers, separate fiber openers 6, 6', common mixing system 7 and air-permeable conveyor belts 4, 4' running parallel above and below. The fibers are each fed from the feed arrangement 5, 5' into a fiber opener 6, 6'. The fiber openers 6, 6' are followed by a common mixing system 7 for mixing the fibers for homogeneous distribution.

Figure 4:
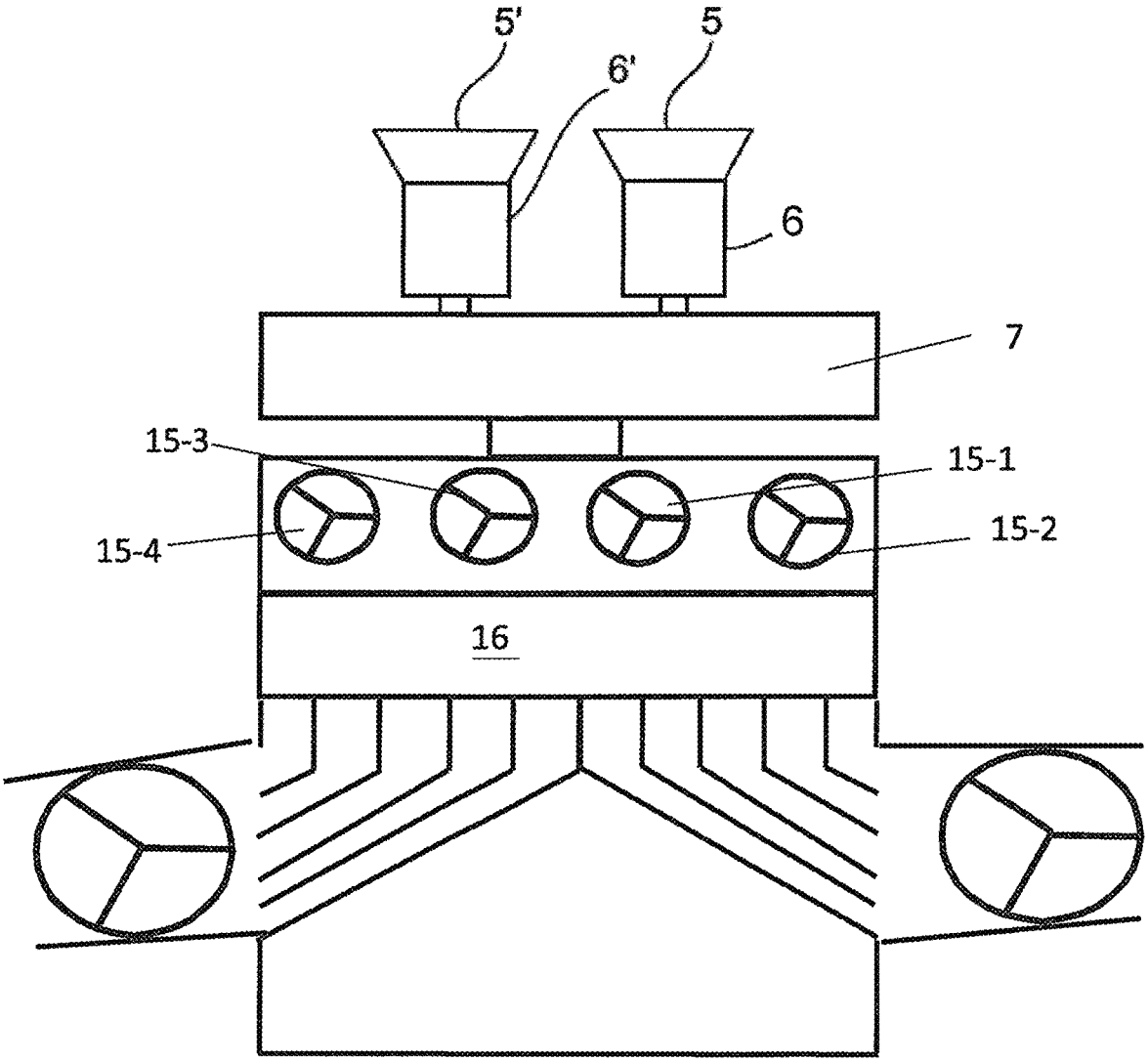

FIG. 4 shows in front view a schematic representation of an embodiment example of a nonwoven fiber manufacturing apparatus 1 with separate feed arrangements 5, 5' of carrier fibers and binder fibers, separate fiber openers 6, 6', common mixing system 7 and air-permeable conveyor belts 4, 4' running parallel above and below. The fibers are each fed from the feed arrangement 5, 5' into a fiber opener 6, 6'. The fiber openers 6, 6' are followed by a common mixing system 7 for mixing the fibers for homogeneous distribution.

Via a system of several fans 15-1-15-4, the air, fiber flow is guided via an air guide channel/a deflection channel 16 into the two parallel, air-permeable conveyor belts 4, 4'.

Via an air suction unit 8, 8',81-8.10 from the outside on the air-permeable conveyor belts 4, 4', suction is applied over the width of the nonwoven fiber with varying strength, also varying over time, and the fibers condense perpendicular to the surface of the conveyor belts in varying density. The start of the air suction 81-8.10 is at the beginning of the conveyor belts and the end of the air suction 82 is directly in front of the system area for thermal bonding. For thermal bonding, a heat source 9 and a cooling source 10 are connected in series. The finished nonwoven fabric/fiber web is then further processed in subsequent production steps.

Figure 5:
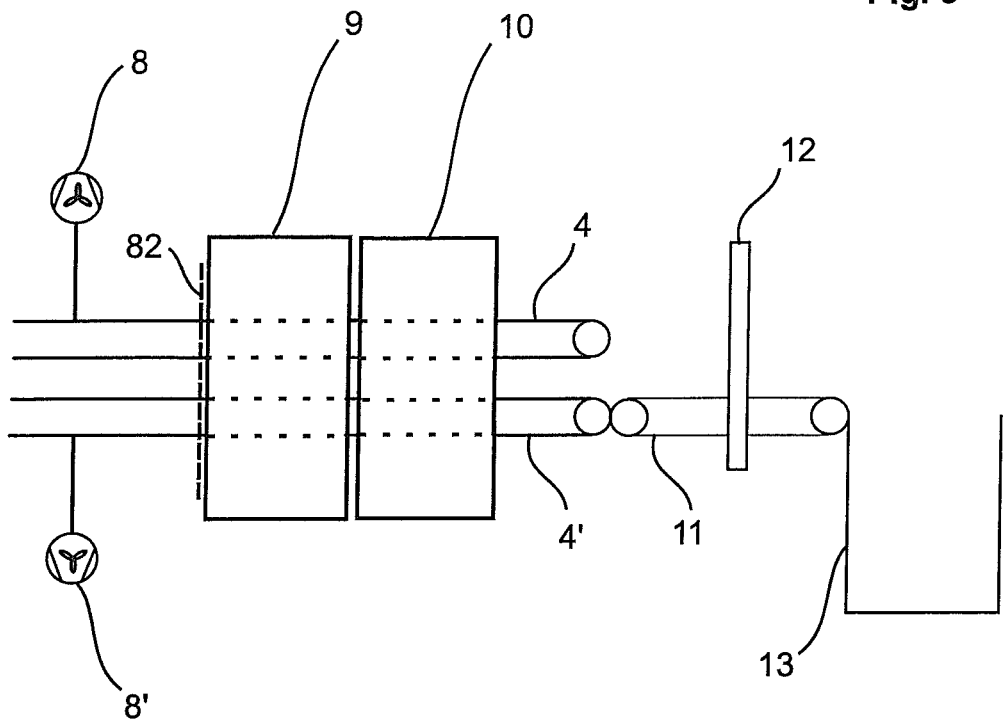

FIG. 5 shows a schematic representation of the rear section of an embodiment of a nonwoven fiber manufacturing apparatus 1 with air-permeable conveyor belts 4, 4' running parallel at the top and bottom, a heat source 9, a cooling source 10 and a downstream conveyor belt 11 with cutting device 12. The finished nonwoven fiber boards 2 are collected in a product collection container 13. The end of the air suction 82 is directly in front of the system area for thermal bonding with heat source 9 and cooling source 10.

Figure 6:
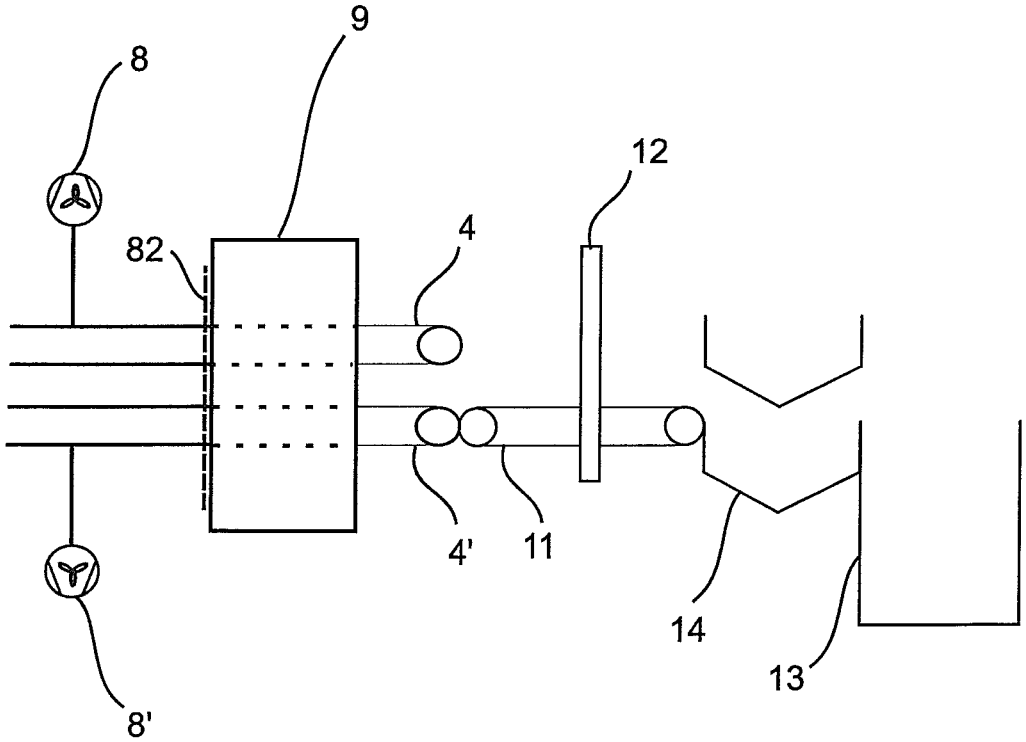

FIG. 6 shows a schematic drawing of the rear section of an embodiment of a nonwoven fiber manufacturing apparatus 1 with air-permeable conveyor belts 4, 4' running parallel at the top and bottom, a heat source 9, a downstream conveyor belt 11 with cutting device 12 and three-dimensional molded parts 14. The lower half of a three-dimensional molded part 14 is moved along under the warm and thus readily moldable nonwoven fabric boards 2. When the conveyor belt 11 ends, the sections are deposited individually on the lower three-dimensional molded part halves. The upper mold part halves are then pressed with a specified pressure onto the lower mold part halves, each filled with a nonwoven fabric board 2, and the nonwoven fiberboard 2 is thus formed. Cooling of the heated nonwoven fabric board 2 formed in the three-dimensional mold parts 14 is performed in the lower halves of the three-dimensional mold parts 14, respectively, before transfer to a product collecting container 13. A finished formed nonwoven fiber product is obtained.

Figure 7:
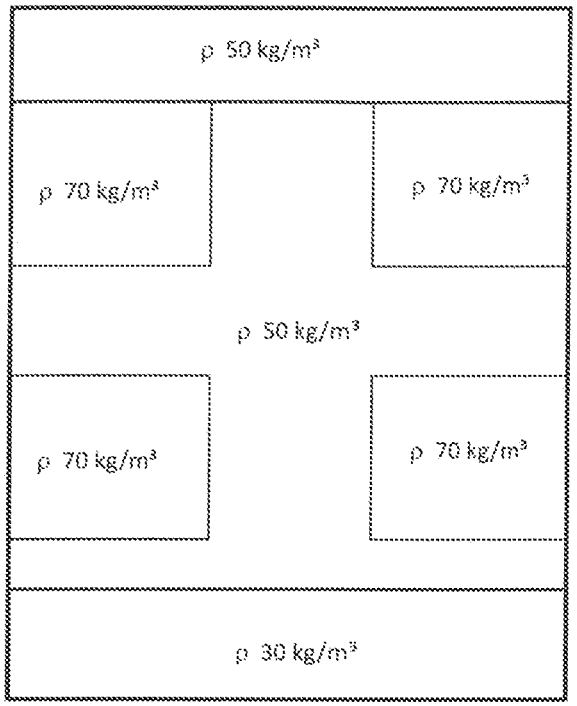

FIG. 7 shows a possible density distribution for the floor insulation of a passenger car. In the foot installation areas, the density is higher for this example at 70 kg/m$^3$, in the tunnel and under the seats at 30 kg/m$^3$.

Figure 8:
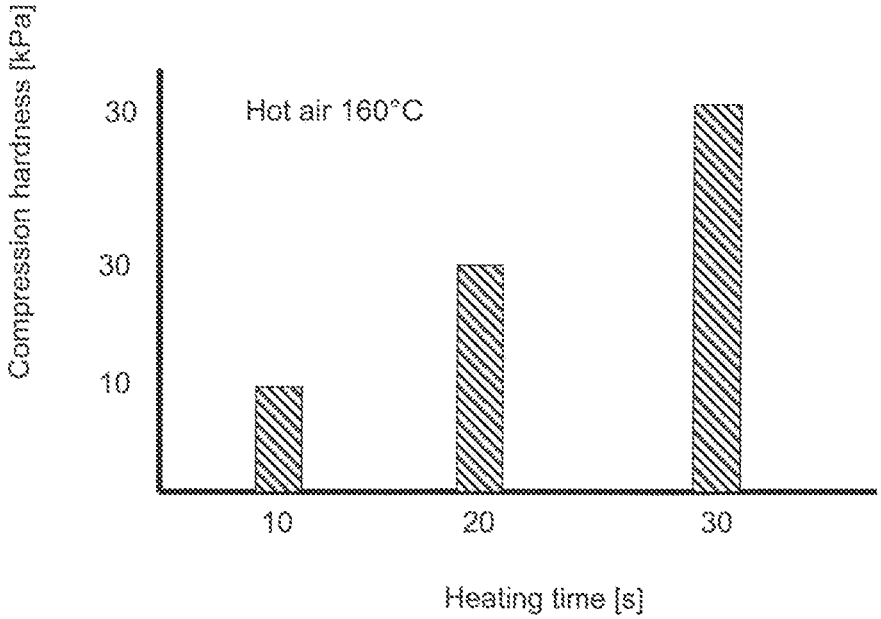

FIG. 8 the compression hardness as a function of the soak time.

Figure 9:
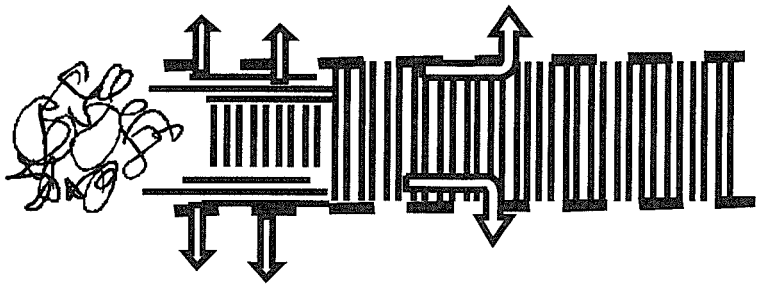

FIG. 9 shows the suction of the fibers in two conveyor belts running at the same speed in such a way that the fibers are sucked in parallel to the belts.

Figure 10:
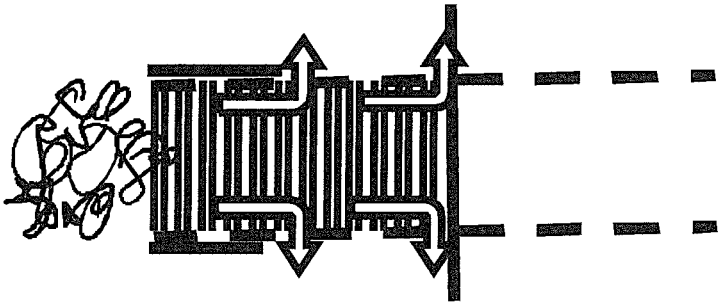
Figure 11:
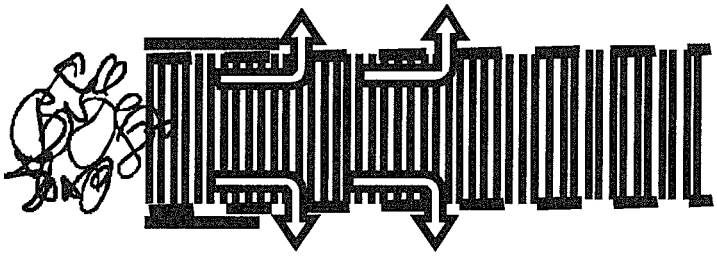

Further, FIG. 10 shows the control of fiber filling at the start of production and FIG. 11 shows the fiber arrangement in the belts during continuous production.

Figure 12:
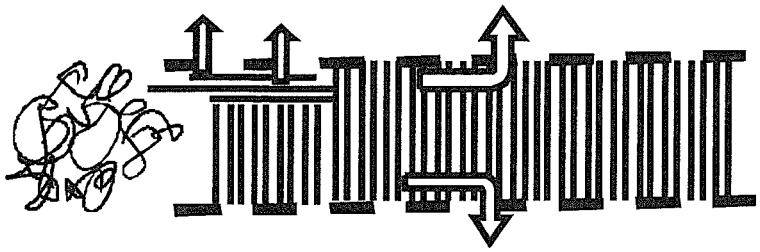

FIG. 12 shows the arrangement of the suction with spatially different suction along the belts at the top and bottom and the arrangement of the fibers in the belts.

LIST OF REFERENCE SIGNS

1 nonwoven fabric manufacturing apparatus
2 nonwoven fabric board
3 perpendicular oriented fibers
4, 4' air permeable conveyor belt
5,5' supply arrangement
6, 6' fiber opener
7, 7' mixing system
8,8' air suction 8-1-8-10
81 start air suction
82 end air suction
9 heat source
10 cooling source
11 conveyor belt
12 cutting device
13 product collection container
14 three-dimensional molded part
15-1-15-4 fans for controlling the air and pressure control nozzles
16 air guide channels

The invention claimed is:

1. A nonwoven fabric manufacturing apparatus (1) comprising:

a supply arrangement (5, 5') for carrier fibers;

a supply arrangement (5, 5') for binder fibers;

at least one opening arrangement or opening/loosening combing arrangement or at least one fiber opener (6, 6') for combing, separating, loosening and detaching the carrier fibers and/or binder fibers;

at least one mixing system (7, 7') for mixing the loosened or detached fibers;

a transport system with air suction (8, 8') in the front section of the transport system for aligning and depositing the fibers consisting of air guide channels and pressure control nozzles (15-1-15-4)

and with a heat source (9) in the rear section of the transport system with subsequent cooling source (10) for thermal bonding of the resulting nonwoven fabric, wherein the front section of the transport system with air suction (8, 8') consists of opposing air-permeable conveyor belts (4, 4') running at the same speed, and the loosened and mixed fibers are conveyed between the opposing conveyor belts, and the fibers are arranged in different density over the width and length of the nonwoven fabric on the transport belts perpendicular to the conveyor belts due to the air suction (8, 8') (8-1-8-10) from the outside.

2. The nonwoven fabric manufacturing apparatus (1) according to claim 1, wherein a conveyor belt (11) for transporting away the nonwoven fiber is arranged downstream of the transport system with air suction (8, 8') and heat source (9).

3. The nonwoven fabric manufacturing apparatus (1) according to claim 1, wherein a cutting device (12) for dividing the nonwoven fabric into sections/nonwoven fiber sheets or blanks is located on the conveyor belt (11).

4. The nonwoven fabric manufacturing apparatus (1) according to claim 1, wherein three-dimensional moldings (14) are arranged downstream of the conveyor belt (11) and the cutting device (12).

5. The nonwoven fabric manufacturing apparatus (1) according to claim 1, wherein the cooling source (10) for thermal bonding and consolidation is arranged downstream of the heat source (9) in the rear section of the transport system or for cooling the content of the three-dimensional molded part (14).

6. The nonwoven fabric sheet or board produced by means of a nonwoven fabric manufacturing apparatus (1)

according to claim 1, wherein the nonwoven fabric sheet has a defined density distribution over the length and the width.

* * * * *